US006616805B2

(12) United States Patent
Takano et al.

(10) Patent No.: US 6,616,805 B2
(45) Date of Patent: Sep. 9, 2003

(54) OFFSET PRINTING PAPER

(75) Inventors: Toshiyuki Takano, Tokyo (JP); Hiroshi Ono, Tokyo (JP); Hideki Fujiwara, Tokyo (JP)

(73) Assignee: Nippon Paper Industries, Co., Ltd., Tokyo (JP)

( * ) Notice: Subject to any disclaimer, the term of this patent is extended or adjusted under 35 U.S.C. 154(b) by 0 days.

(21) Appl. No.: 09/956,506

(22) Filed: Sep. 19, 2001

(65) Prior Publication Data

US 2002/0121351 A1 Sep. 5, 2002

(30) Foreign Application Priority Data

Sep. 28, 2000 (JP) ..... 2000-295659
Jul. 30, 2001 (JP) ..... 2001-230467

(51) Int. Cl.[7] ..... D21F 11/00; D21F 13/00; D21F 15/00

(52) U.S. Cl. ..... 162/135; 162/134; 162/168.1; 162/168.3; 162/173; 428/342; 428/478.8; 428/479.3

(58) Field of Search ..... 162/134, 135, 162/168.1, 168.3, 173, 164.1, 136; 428/342, 478.8, 479.3, 479.6

(56) References Cited

U.S. PATENT DOCUMENTS 5,750,253 A * 5/1998 Satake et al. ..... 428/342

* cited by examiner

*Primary Examiner*—Steven P. Griffin
*Assistant Examiner*—M. Halpern
(74) *Attorney, Agent, or Firm*—Knobbe, Martens, Olson & Bear LLP

(57) ABSTRACT

A surface-treating agent mainly includes three constituents: a water-soluble polymer; a surface sizing agent which is a copolymer of a styrene type monomer and an anionic monomer and which mainly includes a water-soluble copolymer containing 20 to 80 weight % of the styrene type monomer; and a surface sizing agent which is a copolymer of an olefin type monomer and an anionic monomer and which mainly includes a water-soluble copolymer containing 20 to 80 weight % of the olefin type monomer. The surface-treating agent is coated and dried on a base paper for offset printing.

19 Claims, No Drawings

OFFSET PRINTING PAPER

This application is the U.S. application Ser. No. 09/956, 506, filed Sep. 19, 2001, which claims priority to Japanese Patent Application Nos. 2000-95659, filed Sep. 28, 2000, and 2001-230467, filed July 30, 2001.

BACKGROUND OF THE INVENTION

1. Field of the Invention

The present invention relates to an offset printing paper with excellent color printability, particularly to an offset printing paper for newspaper.

2. Description of the Related Art

In recent years, printing technologies have made great progress including offset printing, color printing, high-speed mass printing, automation, etc. With the advance of technologies related to printing paper, improvement of its various physical properties is demanded from the workability and printability aspects.

Particularly, for offset printing, because a dampening solution is used with ink on a printing press, a stress applied to the paper is greater than conventional copperplate printing. For this reason, the offset paper requires to possess moderate water absorbency resistance (i.e., a size property).

There are two methods for giving a size property to printing paper, a method using an internal size and a method using an external size (surface size). The former is a method for including a chemical inside the paper by adding an internal size (e.g., a rosin size, an enhanced rosin size, a neutral rosin size, an alkylketene dimer (AKD), alkenyl succinic acid anhydride (ASA), etc.) in paper pulp slurry in wet-end. The latter is a method for coating the paper with a surface size (e.g., a styrene/maleic acid type copolymer, a styrene/acrylic acid type copolymer, olefin/maleic acid type copolymer, a urethane type copolymer, etc.) using a coating machine such as a size press or a gate roll coater after the paper is made.

The internal sizes, however, have many problems in terms of costs, quality and workability, etc. including (1) It is necessary to add a chemical in low-concentration pulp slurry, (2) A fixing amount of the chemical in pulp sheet varies, (3) Whitewater system is polluted, etc. The method using an external size does not have the above-mentioned problems, and thus is preferable.

For the printing paper, it is common that a water-soluble polymer such as a starch, a chemically engineered starch, polyvinyl alcohol (PVA) or polyacrylamide (PAM), etc. is surface-coated as a measure for improving the surface strength of the paper. Therefore, in the external size method a surface size should be used together with these materials.

For example, a method for using a surface size mainly comprising a water-soluble polymer containing a styrene type monomer (a styrene type surface size) together with a starch has been widely used. As examples, Japanese Patent Laid-open No. 1985-185894, Japanese Patent Laid-open No. 1993-247888, Japanese Patent Laid-open No. 1999-140791, etc. can be mentioned.

Surface sizes mainly comprising a water-soluble polymer containing an olefin type monomer (ethylene, propylene, isobutylene, diisobutylene, octene, decene, etc.) (olefin type surface sizes) are well known.

For example, a diisobutylene-maleic acid type surface size was disclosed in Japanese Patent Laid-open No. 1975-89603; diisobutylene-maleic anhydride type surface sizes were disclosed in Japanese Patent Laid-open No. 1980-67094 and Japanese Patent Laid-open No. 1985-9994; a surface size comprising a water-soluble polymer containing α-olefin and (metha)acrylic ester is disclosed in Japanese Patent Laid-open No. 1990-200896, Japanese Patent Laid-open No. 1990-269895 and Japanese Patent Laid-open No. 1991-8894.

Because a surface size is basically a material having both a hydrohobic group and a hydrophilic group, it can cause foaming. Thus, a surface size which exhibits high size performance after using in a small amount is desirable.

An increase in color printing is also a remarkable phenomenon. As a result, the color printability of the paper (e.g., improvement of ink acceptability, etc.) has become one of the requirements as well.

Improvement of color printability by using a water-soluble polymer and a styrene type surface size together is disclosed in Japanese Patent Laid-open No. 1999-140791.

Newsprint (a roll of newsprint) printing paper mainly comprises mechanical pulp or deinked pulp (DIP). Although the newsprint is classified into medium/low-grade paper, it has to withstand more harsh conditions than regular printing paper because newspaper printing for the specified number of copies has to be done within a specified time period.

To improve paper strength of the newsprint, a starch, PVA or PAM is coated on. As a method for coating the newsprint, in Japan, normally a gate roll coater (GRC) which is a coat-forming transferring system capable of high-speed coating is used. Characteristics of the GRC system is briefly summarized for example in proceedings of the Japan Technical Association of the Pulp and Paper Industry Vol. 43, No. 4 (1989), p.36, the Paper Pulp Technical Times Vol. 36, No. 12 (1993), p.20 and others.

SUMMARY OF THE INVENTION

The object of the present invention is to provide offset paper, particularly newsprint for offset printing, which possesses a moderate size property (water absorbency resistance) and excellent color printability.

The inventors of the present invention found that mixing surface sizes such as a styrene type surface size and an olefin type surface size has synergistic effects on water absorbency resistance when coating on the a base printing paper (particularly, a base paper for newsprint) and drying the coating. The satisfactory size effect (an effect of providing water absorbency resistance) and excellent color printability can be achieved by coating a small amount. From these findings, the inventors have solved the objectives of the present invention.

The present invention relates to offset paper which is made by coating a surface-treating agent mainly comprising three constituents: Constituent A, Constituent B and Constituent C shown below, on a base paper for printing, and drying the coating.

Constituent A: A water-soluble polymer.

Constituent B: A surface sizing agent which is a copolymer of a styrene type monomer and an anionic monomer and which mainly comprises a soluble copolymer including 20 to 80 weight % of the styrene type monomer.

Constituent C: A surface sizing agent which is a copolymer of an olefin type monomer and an anionic monomer and which mainly comprises a soluble copolymer including 20 to 80 weight % of the olefin type monomer.

DETAILED DESCRIPTION OF THE PREFERRED EMBODIMENT

Offset newsprint described below is made by coating and drying a surface-treating agent mainly comprising three constituents, Constituent A, Constituent B and Constituent C shown below.

According to the present invention a water-soluble polymer of Constituent A to be used for a surface-treating agent may be chosen from starches such as starch, oxygen denatured starch, thermochemically denatured starch, oxidized starch, esterified starch, etherificated starch (a hydroxyethylated starch, etc.) and cationized starch, polyvinyl alcohols such as polyvinyl alcohol, completely saponificated polyvinyl alcohol, partially saponificated polyvinyl alcohol, carboxyl denatured polyvinyl alcohol, silanol denatured polyvinyl alcohol, cation denatured polyvinyl alcohol and terminal alkyl denatured polyvinyl alcohol, polyacrylamides such as polyacrylamide, cationic polyacrylamide, anionic polyacrylamide and amphoteric polyacrylamide, and celluloses such as carboxylmethyl cellulose, hydroxyethyl cellulose and methyl cellulose can be mentioned. These are used independently or by mixing two or more types.

Constituent A used for a surface-treating agent according to the present invention carries out a major role in respect of surface strength improvement (i.e., paper powder suppression). At the same time, however, Constituent A can cause a peculiar newsprint-specific trouble called "Neppari", when a surface-treating agent is transferred to a blanket and accumulated on it during mass printing newsprint. To balance the surface strength improvement and the "Neppari" problem, Constituent A according to the present invention is chosen from starches mentioned above. Among the starches, an oxidized starch, an esterified starch and an etherificated starch are most preferable.

Constituent B used for a surface-treating agent according to the present invention is a copolymer of a styrene type monomer and an anionic monomer, which mainly comprises a soluble copolymer including 20 to 80 weight % of the styrene type monomer. As a styrene type monomer, styrene, α-methylstyrene, chlorostyrene and cyanostyrene can be mentioned as examples. As an anionic monomer, an acrylic acid type monomer (acrylic acid, methacrylic acid, crotonic acid, isocrotonic acid, 2-ethylacrylic acid, 3-tert-butylacrylic acid, acrylic acid methyl, acrylic acid ethyl, acrylic acid isobutyl, acrylic acid octenyl, etc.), a maleic acid monomer (maleic acid, methylmaleic acid, phenylmaleic acid, chloromaleic acid, fumaric acid, itaconic acid, muconic acid, maleic acid methyl, maleic acid tert-butyl, maleic acid diethyl, etc.) can be mentioned as examples.

As a water-soluble copolymer used as Constituent B, specifically, a styrene/acrylic acid copolymer, a styrene/(metha)acrylic acid copolymer ("(metha)acrylic acid" means "acrylic acid and/or methacrylic acid".), a styrene/(metha)acrylic acid/(metha)acrylic acid ester copolymer, a styrene/maleic acid copolymer, a styrene/maleic acid half-ester copolymer and a styrene/maleic acid ester copolymer, etc. are applicable. This copolymer can also be used as sodium salt, potassium salt or ammonium salt. This copolymer can be used independently or by mixing two or more types.

In the copolymer of the Constituent B, for the ratio of a styrene type monomer and an anionic monomer, a ratio within a range from '80 to 20' to '20 to 80' is preferable. Additionally, at least more than one type of each of a styrene type monomer and an anionic monomer is used. A small amount of a monomer polymerized with the above-mentioned styrene type monomer and/or anionic monomer can be copolymerized to the extent not interfering with the present invention.

As a method for producing this copolymer, for example, an aqueous polymerization method, a solvent polymerization method, a reversed emulsification polymerization method, a precipitation polymerization method, a suspension polymerization method, etc. can be mentioned.

The average molecular weight of this copolymer should be within the limits of 1,000 to 1,000,000, preferably within the limits of 1,000 to 100,000. If the molecular weight is smaller than 1000, this copolymer cannot form a satisfactory coat and thus it is not preferable in terms of surface strength improvement effects. If the molecular weight is larger than 1,000,000, operation-related problems originating from increased viscosity, etc. may occur.

As Constituent C used for a surface-treating agent according to the present invention is a copolymer of an olefin type monomer and an anionic monomer, which contains 20 to 80 weight % of the olefin type monomer. As an olefin type monomer, ethylene, propylene, n-butylene, isobutylene, octene, decene, etc. can be mentioned as examples. As an anionic monomer, an acrylic acid type monomer (acrylic acid, methacrylic acid, crotonic acid, isocrotonic acid, 2-ethylacrylic acid, 3-tert-butylacrylic acid, acrylic acid methyl, acrylic acid ethyl, acrylic acid iso-butyl, acrylic acid octenyl, etc.), a maleic acid type monomer (maleic acid, methymaleic acid, phenylmaleic acid, chloromaleic acid, fumaric acid, itaconic acid, muconic acid, maleic acid methyl, maleic acid tert-butyl, maleic acid diethyl, etc.), etc. can be mentioned.

As a water-soluble copolymer used for Constituent C, specifically an ethylene/acrylic acid copolymer, an isobutylene/acrylic acid copolymer, n-butylene/(metha)acrylic acid/(metha)acrylic acid copolymer, a propylene/maleic acid copolymer, an ethylene/maleic acid copolymer, etc. are applicable. This copolymer can also be used as sodium salt, potassium salt or ammonium salt. This copolymer can be used independently or by mixing two or more types.

In this copolymer, a ratio of an olefin type monomer and an anionic monomer in a range from '80 to 20' to '20 to 80' is preferable. Additionally, more than one type of an olefin type monomer and an anionic monomer can be used. A small amount of a monomer polymerized with the above-mentioned olefin type monomer and/or anionic monomer can be copolymerized to the extent not interfering with the present invention.

As a method for producing this copolymer, for example, an aqueous polymerization method, a solvent polymerization method, a reversed emulsification polymerization method, a precipitation polymerization method, a suspension polymerization method, etc. can be mentioned.

The average molecular weight of this copolymer should be within the limits of 1,000 to 1,000,000, preferably within the limits of 1,000 to 100,000. If the molecular weight is smaller than 1000, this copolymer cannot form a satisfactory coat and thus is not preferable in terms of its surface strength improvement effects. If the molecular weight is larger than 1,000,000, operation-related problems originating from increased viscosity, etc. may occur.

Since the ratio (weight ratio) of each constituent of the surface-treating agent according to the present invention depends on the qualities demanded for newsprint produced, it cannot be always specific. If venturing to be specific, however, within the ranges of 100:0.1~50:0.1~50 is appropriate for the ratio of Constituent A to Constituent B to Constituent C (A:B:C). If the ratio of Constituent B or Constituent C is less than 0.1 parts, there is a problem in achieving the sufficient size property. If the ratio exceeds 50 parts, there are problems in economical efficiency and workability. The ratio within the ranges of A:B:C= 100:2~20:2~20 is further preferable.

The surface-treating agent according to the present invention can be prepared by mixing the three constituents. Any combination from which an insoluble precipitate is generated when mixing the constituents is not suitable for the present invention.

In an embodiment, the above surface-treating agent consists essentially of Constituents A, B, and C, wherein only Constituents A, B, and C are active ingredients with respect to the drop-by-drop titration water absorbency and the contact angle. In an embodiment, the above surface-treating agent is exclusively used as a surface-treating agent, wherein no other surface-treating agent is used in combination. However, the surface-treating agent according to the present invention can contain additives such as an additive for preventing the "Neppari" caused by the surface-treating agent being transferred to and accumulating on the blanket, an antiseptic, a defoaming agent, a UV rays protective agent, a color preserving agent, an optical whitening agent, a viscosity stabilizer, a lubricant, an anti-slipping agent, etc., or a filler, provided that no adverse effect is exhibited. Such additives may be less than 10% of the surface-treating agent in an embodiment or less than 5% in another embodiment. Further, in an embodiment, no internal sizing agent is used.

A base paper for newsprint is made using publicly known and officially used papermaking machines by mixing mechanical pulp (MP) such as grand pulp (GP), thermomechanical pulp (TMP), chemithermomechanical pulp (CTMP), semi-chemical pulp, chemical pulp (CP) such as kraft pulp (KP), deinked pulp (DIP) which is obtained by deinking used papers containing these different types of pulp, recycled pulp which is obtained by refining brokes from the papermaking process and others, independently or at an optional mixing ratio. The preferred mixing ratio of DIP is within the limits of 50 to 100% in consideration of the recent trend in high DIP mixing ratios. The basis weight of a base paper is not particularly limited, but is approximately 34 to 45 g/m$^2$.

To this base paper for newsprint, publicly known and officially used fillers for papermaking and chemicals for papermaking can be added suitably if required. As fillers, white carbon, clay, silica, talc, titanium oxide, calcium carbonate, synthetic resin fillers (vinyl chloride resin, polystyrene resin, urea formalin resin, melamine resin, styrene/butadiene type copolymer resin, etc.), etc. can be added. Particularly for neutral papermaking, calcium carbonate is effectual. As chemicals for papermaking, paper strength enhancing chemicals such as polyacrylamide type polymers, polyvinyl alcohol type polymers, a cationized starch, urea/formalin resin and melamine/formalin resin, freeness/yield improving chemicals such as salt which is a copolymer of acrylamide and aminomethylacrylamide, a cationized starch, polyethylene imine, polyethylene oxide and acrylamide/acrylic acid natrium copolymers, sizing agents such as rosin sizes, emulsion sizes, alkyl ketene dimers (AKD) and alkenyl succinic acid anhydrides (ASA), auxiliaries such as aluminium sulfate (sulfate band), a UV rays protective agent, a color preserving agent and a defoaming agent can be added. As to the physical properties of this base paper, the base paper should possess tensile strength, tearing strength, elongation, etc. of average newsprint since it needs to be printable using an offset printing press.

As this base paper for newsprint, a base paper with an internal size can also be used. Because the present invention solves the above-mentioned problem resulting from using the internal size, the effects of the present invention can be further exhibited using a base paper for which the internal size was not used. In other words, by externally coating the base paper using the surface-treating agent according to the present invention and without using the internal sizes, water absorbency resistance can be provided to the same degree or more than using of the internal sizes. For example, the surface-treating agent according to the present invention can be satisfactorily applied to newsprint taking less than 10 seconds to absorb a waterdrop according to a method for measuring the water absorbency by dropping a waterdrop (a method in accordance with the Japan TAPPI No. 33, incorporated herein by reference: a method for measuring time required until a waterdrop to be absorbed on a paper surface by dropping 1 microliter of water on the paper surface).

Additionally, the base paper for newsprint according to the present invention can be a base paper for newsprint prepared by acid papermaking or a base paper for newsprint prepared by neutral or alkaline papermaking. The surface-treating agent according to the present invention is effective particularly on a base paper for newsprint prepared by neutral or alkaline papermaking.

Newsprint for offset printing according to the present invention is obtained by coating a surface-treating agent comprising Constituents A, B and C on a base paper for newspint and drying the coating.

Although an application quantity of the surface-treating agent according to the present invention (i.e., the total of the solid quantities of Constituents A, B and C) should be determined in accordance with the quality (size property, color printability, etc.) of newsprint to be manufactured and should not be particularly limited, an application quantity (per both sides) of approximately 0.1 to 1.5 g/m$^2$ is appropriate. For example, if an application quantity is less than 0.1 g/m$^2$, the effects of the surface-treating agent are not achieved sufficiently in terms of improvement of a size property and surface strength. If the quantity exceeds 1.5 g/m$^2$, a possibility that a surface-treating agent is transferred to a blanket and accumulated becomes high. Additionally, regarding the surface-treating agent according to the present invention, when Constituent A comprises starches for improving surface strength an appropriate application quantity of the said agent is approximately 2 to 1.2 g/m$^2$. This quantity, however, does not apply to offset papers other than newsprint, for which an appropriate application quantity should be approximately 0.5 to 4.0 g/m$^2$.

To determine an appropriate application quantity of the surface-treating agent according to the present invention, a balance with the paper's surface strength against the "Neppari" needs to be considered. For the newsprint for offset printing according to the present invention, the strength against the "Neppari" should be less than 70 g f/3 cm (0.69N/3 cm). In the case when starches are used for Constituent A of the surface-treating agent according to the present invention, upon using a combination of starches and Constituent B or a combination of starches and Constituent C to prepare coated and dried newsprint, the tolerance against the "Neppari" shows a tendency to go up. This indicates that some synergistic action exists between Constituent B and Constituent C. For this reason, for the newsprint for offset printing according to the present invention, a balance with the tolerance against the "Neppari" needs to be maintained.

As a device for coating the surface-treating agent (a coater) according to the present invention, as long as it is a normal coater for papermaking, there is no limitation placed on the device used. For example, a 2-roll size press, blade-metalling size press, rod-metalling size press, gate roll coater, bar coater, air knife coater, etc. can be mentioned.

Among the devices, a coat-transferring type coater whose most representative type is a gate roll coater is preferable. In the case of newsprint, a gate roll coater (GRC) is common, and it is most preferably used for the present invention as well.

Because it is common in papermaking that coating of the surface-treating agent is performed with a coater equipped on the papermaking machine, a coating rate should be approximately the same as a papermaking rate, which is within the limits of 800 to 1800 m/min.

The newsprint for offset printing according to the present invention is obtained by calendering to obtain the paper thickness and smoothness suitable for offset printing. As a calender to be used, a normal hard-nip calender, or a soft-nip calender (For example, calenders are summarized in the Paper Pulp Technical Times Vol. 43, No. 1 (2000), p.23, etc.) can be mentioned. If in the future the newsprint becomes lighter, soft-nip calendering is more preferable to use for the newsprint for offset printing according to the present invention. As for conditions for soft-nip calendering, temperature should be within the limits of 30° C. to 150° C. and line pressure is within the limits of 20 to 150 kN/m according to the qualities (paper thickness, smoothness, etc.) demanded for the newsprint. In respect of color printability, combining the surface-treating agent according to the present invention with soft-nip calendering is preferred.

The water absorbency resistance of the newsprint for offset printing according to the present invention should be determined appropriately according to specifications demanded for a product, and is not particularly limited. If venturing to limit using a method for measuring the water absorbency by dropping a waterdrop, it is acceptable if drop water absorbency is within the limits of 10 to 1000 sec, particularly preferable if it is within the limits of 15 to 300 sec. If limiting using a method by the contact angle of a waterdrop (the contact angle in a prescribed time after dropping a waterdrop on the paper), which is described in Japanese Patent Laid-open No. 1996-232193 or Japanese Patent Laid-open No. 1999-140791, it is preferable that a contact angle in 0.1 sec after dropping a 5 microliter drop of water on the paper is 90 degrees or higher. A contact angle in 5 sec was measured in Japanese Patent Laid-open No. 1996-232193 and a contact angle in 1 sec was measured in Japanese Patent Laid-open No. 1999-140791. Considering the time required for actual newsprint for offset printing, the time for measuring a contact angle should be as short as possible, and in the present invention, a contact angle after 0.1 sec was evaluated. In contrast to the method for measuring the water absorbency by dropping a waterdrop which evaluates a static size property, the method using a contact angle is considered to evaluate a dynamic size property. The former accommodates paper behavior during the time from a dampening solution adhering to the paper by an offset rotary printing press to the paper being discharged as a printed paper. The latter accommodates paper behavior during the time between the drums of, for example, a color printing press such as a satellite type. The two types are used for evaluation of different phenomena. Consequently, to improve color printability, the paper should have both qualities. For this reason, it is preferable that the newsprint for offset printing according to the present invention has the qualities of drop water absorbency within the limits of 10 to 1000 sec and a contact angle of 90 degrees or higher after 0.1 sec by dropping a 5 microliter drop of water.

The color printability of the newsprint for offset printing according to the present invention cannot be particularly specified because there is no appropriate method for measuring the color printability. It is acceptable as long as a type page of the newsprint is satisfactory when printing by a color printing press.

[Action]

According to the present invention, newsprint for offset printing, which has excellent color printability possessing drop water absorbency within the limits of 10 to 1000 s and a contact angle of 90 degrees or higher after 0.1 s by dropping a 5 microliter drop of water, can be obtained by coating the surface-treating agent mainly comprising three constituents, Constituents A to C, on a newsprint base paper in the amount of 0.1 to 1.5 g/m$^2$ using a gate roll coater.

Because Constituent B and Constituent C of the surface-treating agent used in the present invention are frequently used as surface-treating agents, it is reasonable to expect high size property that the surface-treating agent according to the present invention provides. Reasons for synergistic effects, in which a mixed use of Constituent B and Constituent C has a better size property than an independent use of Constituent B or Constituent C, have not been known. It has been recognized, however, that Constituent B tends to increase drop water absorbency and that Constituent C tends to increase a contact angle. It is believed that because the mechanisms of the respective constituents for providing a size property are different, synergistic effects of size property improvement were shown.

In respect of color printability, because Constituent C is excellent in ink compatibility, this is considered to contribute to the ink acceptability of the paper.

EXAMPLES

The present invention is described in but is not limited to the following examples. Additionally, in the examples, parts and % imply 'parts by weight' and 'weight %' unless otherwise specified.

<The Surface-Treating Agent>

As the surface-treating agent, the following respective constituents were synthesized or obtained:

<Constituent A>

A-1: Oxidized starch (Product name: SK-20 produced by Japan Cornstarch Co.)

A-2: Hydroxyethylated starch (Product name: PG-280 produced by Penford Corp.)

A-3: Esterified starch (Product name: Filmkote-370 produced by National Starch Co.)

A-4: Anionic polyacrylamide (Product name: P-120 produced by Seiko Chemical Industries)

<Constituent B>

B-1: Styrene/acrylic acid copolymer (Mw=56,000)

B-2: Styrene/acrylic acid type surface sizing agent (Product name: KN-520 produced by Harima Chemicals Inc.)

B-3: Styrene/maleic acid copolymer (Mw=48,000)

B-4: Styrene/maleic acid type surface sizing agent (Product name: Koropearl M-150 produced by Seiko Chemical Industries)

<Constituent C>

C-1: Isobutylene/maleic acid copolymer (Mw=34,000)

C-2: Ethylene/acrylic acid copolyer (Mw=15,000)

C-3: Olefin type surface sizing agent (Product name: AK-505 produced by Misawa Ceramics Corp.)

To add to the above, ratios of styrene type monomers from B-1 to B-4 are within the limits of 20 to 80 weight %, and ratios of olefin type monomers from C-1 to C-3 are within the limits of 20 to 80 weight %.

<Making of Newsprint Base Paper A>

White carbon was added at a ratio of 1% per absolute dry pulp to pulp slurry, which is prepared by mixing/ disaggregating 40 parts of DIP (Freeness: 180 ml), 50 parts of TMP (Freeness: 100 ml) and 10 parts of NBKP (Freeness: 600 ml), acid papermaking was performed using a Bel-Baie former type papermaking machine, and Newsprint Base Paper A with 42 g/m$^2$ basis weight was obtained without added size and calendering. The drop water absorbency of the Newsprint Base Paper A was 6 sec.

<Making of Newsprint Base Paper B>

Calcium carbonate was added at a ratio of 1.5% per absolute dry pulp to pulp slurry, which is prepared by mixing/disaggregating 50 parts of DIP (Freeness: 180 ml), 30 parts of TMP (Freeness: 100 ml), 10 parts of NBKP (Freeness: 600 ml), 10 parts of GP (Freeness: 80 ml), neutral papermaking was performed using a Bel-Baie former type papermaking machine, and Newsprint Base Paper B with 42 g/m$^2$ basis weight was obtained without added size and calendering. The drop water absorbency of the Newsprint Base Paper B was 5 sec.

<Making of Newsprint Base Paper>

Examples 1 and 2

A surface-treating agent was prepared by mixing a starch aqueous solution of Constituent A-1, an aqueous solution of Constituent B-1 and an aqueous solution of Constituent C-1 at a mixing ratio shown in Table 1. The obtained surface-treating agent was coated on the Newsprint Base Paper A using a gate roll coater (Coating rate: 1150 m/min, both sides coating). After the coating, high-temperature soft-nip calendering (Roll temperature: 110° C., Line pressure: 130 kN/m) was performed and newsprint for offset printing was made.

The following items of the newsprint for offset printing obtained were evaluated and results are shown in Table 1 below.

Measurement of drop water absorbency: Measured by 1 microliter drop of water in accordance with Japan TAPPI No. 33.

Measurement of a contact angle: a contact angle was measured 0.1 sec after dropping 5 microliter drop of water on the newsprint using a Dynamic Absorption Tester 110DAT (manufactured by Fibro).

Measurement of tolerance against Neppari: Two sheets of the newsprint for offset printing were cut with the dimensions of 4×6 cm, and after soaking the coated sides of the sheets in water at 20° C. for 5 sec, the coated sides of the sheets were pasted together. The paper was joined, rolled at a pressure of 50 kgf/m$^2$ and air conditioned at 25° C. and 60% relative humidity. After making test pieces with a size of 3×6 cm, measurement was made under conditions of tensile rate of 30 mm/min using a tensile tester. The higher the measured values are, the harder it is to peel apart the test pieces (i.e., the stronger adhesiveness is). If the Neppari tolerance is less than 70 g f/3 cm, it is satisfactory as newsprint for offset printing.

Evaluation of color printability: Using an offset rotary printing press (Toshiba offset rotary printing press: OA-4B2T-600), 4-color printing (with the color order of deep blue, magenta, yellow, and black) was performed. The concentration and concentration irregularity of a single color portion of the black, and an overlapped portion of the four colors were visually evaluated.

The type page concentration of the fourth color, Indian ink, is very high and there is no concentration irregularity. In the overlapped portion, a very uniform image is obtained.

The type page concentration of the fourth color, Indian ink, is high and there is nearly no concentration irregularity. In the overlapped portion, a uniform image is obtained.

The type page concentration of the fourth color, Indian ink, is slightly low and concentration irregularity is observed. An image with slightly less clearness is obtained.

The type page concentration of the fourth color, Indian ink, is low and concentration irregularity is clearly observed. In the overlapped portion, an image with lack of clearness is obtained.

Comparative Example 1

Newsprint for offset printing was made in the same manner as described in Examples 1 and 2, except that a surface-treating agent was prepared by mixing a starch aqueous solution of Constituent A-1 and an aqueous solution of Constituent B-1 at a ratio shown in Table 1. The results of evaluation of the obtained newsprint for offset printing are shown in Table 1.

Comparative Example 2

Newsprint for offset printing was made in the same manner as described in Examples 1 and 2 except that a surface-treating agent was prepared by mixing a starch aqueous solution of Constituent A-1 and an aqueous solution of Constituent C-1 at a ratio shown in Table 1. The results of evaluation of the obtained newsprint for offset printing are shown in Table 1.

Comparative Example 3

Newsprint for offset printing was made in the same manner described in Examples 1 and 2 except that a surface-treating agent comprising only a starch aqueous solution of Constituent A-1 was used. The results of evaluation of the obtained newsprint for offset printing are shown in Table 1.

TABLE 1

| | Example 1 | Example 2 | Comparative Example 1 | Comparative Example 2 | Comparative Example 3 |
|---|---|---|---|---|---|
| Constituent A | A-1 | A-1 | A-1 | A-1 | A-1 |
| Constituent B | B-1 | B-1 | B-1 | — | — |
| Constituent C | C-1 | C-1 | — | C-1 | — |
| Mixture Ratio (A:B:C) | 100:5:5 | 100:8:2 | 100:10:0 | 100:0:10 | 100:0:0 |
| Application Quantity (Both sides, g/m$^2$) | 0.62 | 0.58 | 0.60 | 0.64 | 0.61 |
| drop- water absorbency (sec.) | 189 | 248 | 54 | 12 | 6 |
| Contact Angle (degree) | 102 | 97 | 89 | 95 | 70 |
| Neppari Tolerance (g f/3 cm) | 29 | 28 | 17 | 15 | 19 |
| Color Printability | □ | □ | □ to □ | □ | □ |

Examples 3 to 5

A surface-treating agent was prepared by mixing a starch aqueous solution of Constituent A-2, an aqueous solution of Constituent B-3 and an aqueous solution of Constituent C-2 at a ratio shown in Table 2. The surface-treating agent obtained was coated on the Newsprint Base Paper B using a gate roll coater (Coating rate: 1300 m/min, both sides coating). After the coating, high-temperature soft-nip calendering (Roll temperature: 110° C., Line pressure: 130 kN/m) was performed and newsprint for offset printing was made. The results of evaluation of the obtained newsprint for offset printing are shown in Table 2 below.

Comparative Example 4

Newsprint for offset printing was made in the same manner as described in Examples 3 to 5 except that a surface-treating agent used was prepared by mixing a starch aqueous solution of Constituent A-2 and an aqueous solution of B-3 at a ratio shown in Table 2. The results of evaluation of the obtained newsprint for offset printing are shown in Table 2 below.

Comparative Example 5

Newsprint for offset printing was made in the same manner as described in Examples 3 to 5 except that a surface-treating agent was prepared by mixing a starch aqueous solution of Constituent A-2 and an aqueous solution of C-2 at a ratio shown in Table 2. The results of evaluation of the obtained newsprint for offset printing are shown in Table 2 below.

Comparative Example 6

Newsprint for offset printing was made in the same manner as described in Examples 3 to 5 except that a surface-treating agent comprising only a starch aqueous solution of Constituent A-2 was used. The results of evaluation of the obtained newsprint for offset printing are shown in Table 2 below.

Examples 6 to 10

A surface-treating agent was prepared by mixing a starch aqueous solution of Constituents A-1 to A-3, an aqueous solution of Constituents B-1 to B-4 and an aqueous solution of Constituents C-1 to C-3 at a ratio shown in Table 3. The surface-treating agent obtained was coated on the Newsprint Base Paper A using a gate roll coater (Coating rate: 1050 m/min., both sides coating). After the coating, high-temperature soft-nip calendering (Roll temperature: 110° C., Line pressure: 130 kN/m) was performed and newsprint for offset printing was made. The results of evaluation of the obtained newsprint for offset printing are shown in Table 3 below.

Example 11

A surface-treating agent was prepared by mixing a starch aqueous solution of Constituent A-2, an aqueous solution of Constituent B-1 and an aqueous solution of Constituent C-2 at a ratio shown in Table 3. The surface-treating agent obtained was coated on the Newsprint Base Paper A mentioned above using a gate roll coater (Coating rate: 1050 m/min., both sides coating). After the coating, high-temperature hard-nip calendering (Five-step four nips, Roll temperature: 60° C., Line pressure: 35 kN/m) was performed and newsprint for offset printing was made. The results of evaluation of the obtained newsprint for offset printing are shown in Table 3 below.

Example 12

A surface-treating agent was prepared by mixing an anionic polyacrylamide aqueous solution of Constituent A-4, an aqueous solution of Constituent B-1 and an aqueous solution of Constituent C-2 at a ratio shown in Table 3. The obtained surface-treating agent was coated on the Newsprint Base Paper A mentioned above using a gate roll coater (Coating rate: 1000 m/min, both sides coating). After the

TABLE 2

| | Example 3 | Example 4 | Example 5 | Comparative Example 4 | Comparative Example 5 | Comparative Example 6 |
|---|---|---|---|---|---|---|
| Constituent A | A-2 | A-2 | A-2 | A-2 | A-2 | A-2 |
| Constituent B | B-3 | B-3 | B-3 | B-3 | — | — |
| Constituent C | C-2 | C-2 | C-2 | — | C-2 | — |
| Mixture Ratio (A:B:C) | 100:5:5 | 100:3:10 | 100:10:3 | 100:10:0 | 100:0:10 | 100:0:0 |
| Application Quantity (Both sides, g/m$^2$) | 0.48 | 0.45 | 0.40 | 0.52 | 0.53 | 0.55 |
| drop- water absorbency (sec.) | 52 | 38 | 115 | 18 | 8 | 6 |
| Contact Angle (degree) | 99 | 106 | 100 | 87 | 103 | 62 |
| Neppari Tolerance (g f/3 cm) | 28 | 29 | 31 | 24 | 22 | 28 |
| Color Printability | □ | □ | □ | □ to □ | □ | □ |

coating, high-temperature hard-nip calendering (Five-step four nips, Roll temperature: 60° C., Line pressure: 35 kN/m) was performed and newsprint for offset printing was made. The results of evaluation of the obtained newsprint for offset printing are shown in Table 3 below.

TABLE 3

| | Example 6 | Example 7 | Example 8 | Example 9 | Example 10 | Example 11 | Example 12 |
|---|---|---|---|---|---|---|---|
| Constituent A | A-1 | A-1 | A-1 | A-2 | A-3 | A-2 | A-4 |
| Constituent B | B-2 | B-3 | B-4 | B-1 | B-1 | B-1 | B-1 |
| Constituent C | C-1 | C-1 | C-1 | C-2 | C-3 | C-2 | C-2 |
| Mixture Ratio (A:B:C) | 100:15:20 | 100:5:10 | 100:3:3 | 100:5:5 | 100:3:5 | 100:5:5 | 100:30:30 |
| Application Quantity (Both sides, g/m$^2$) | 0.40 | 0.46 | 0.98 | 0.65 | 0.57 | 0.60 | 0.28 |
| drop- water absorbency (sec.) | 798 | 298 | 392 | 165 | 82 | 141 | 45 |
| Contact Angle (degree) | 106 | 100 | 98 | 104 | 103 | 103 | 103 |
| Neppari Tolerance (g f/3 cm) | 29 | 31 | 52 | 28 | 28 | 27 | 28 |
| Color Printability | □ to □ | □ | □ to □ | □ | □ | □ to □ | □ to □ |

[Effects of the Invention]

Newsprint for offset printing on which a surface-treating agent containing Constituents A, B and C according to the present invention was coated and dried improved remarkably both in the drop-by-drop titration water absorbency and the contact angle. On the contrary, newsprint for offset printing on which a surface-treating agent was used that contained only two constituents, Constituents A and B or Constituents A and C did not improved remarkably both in the drop water absorbency and the contact angle. According to the present invention, the same results were obtained both for acid papermaking and neutral papermaking. Furthermore, it was found that newsprint for offset printing according to the present invention possessed excellent color printability.

What is claimed is:

1. An offset printing paper which is made by coating a surface-treating agent mainly comprising three constituents: Constituent A, Constituent B, and Constituent C on a base paper for printing and drying the coating, wherein Constituent A comprises water-soluble polymers;

Constituent B comprises a surface sizing agent which is a copolymer of a styrene type monomer and an anionic monomer, said copolymer mainly comprising a water-soluble copolymer containing 20 to 80 weight % of the styrene type monomer;

Constituent C comprises a surface sizing agent which is a copolymer of an olefin type monomer and an anionic monomer, said copolymer mainly comprising a water soluble copolymer containing 20 to 80 weight % of the olefin type monomer.

2. An offset printing paper for newspaper which is made by coating and drying a surface-treating agent mainly comprising the three constituents: Constituent A, Constituent B, and Constituent C as claimed in claim 1 and drying the coating.

3. The offset printing paper for newspaper as claimed in claim 1, wherein drop water absorbency is in the range of 10 to 300 seconds as measured upon dropping one microliter of water, and a contact angle is in the range of approximately 90 to 106 degrees.

4. An offset printing paper comprising a base paper and a coating formed on the base paper by applying a surface-treating agent comprising mainly:

Constituent A consisting of water-soluble polymers;

Constituent B consisting of a surface sizing agent which is a water-soluble copolymer of a styrene type monomer and an anionic monomer, said copolymer containing 20 to 80% by weight of the styrene type monomer; and Constituent C consisting of a surface sizing agent which is a water-soluble copolymer of an olefin type monomer and an anionic monomer, said copolymer containing 20 to 80% by weight of the olefin type monomer.

5. The offset printing paper according to claim 4, which has a drop water absorbency of 10 to 300 seconds as measured upon dropping one microliter of water, and a contact angle of approximately 90 to 106 degrees as measured 0.1 seconds after dropping five microliters of water.

6. The offset printing paper according to claim 4, wherein the weight ratio of Constituents A/B/C is approximately 100/0.1–50/0.1–50.

7. The offset printing paper according to claim 6, wherein the weight ratio of Constituents A/B/C is approximately 100/2–20/2–20.

8. The offset printing paper according to claim 4, wherein the surface-treating agent contains no other elements adversely affecting the drop water absorbency and the contact angle.

9. The offset printing paper according to claim 4, wherein the surface-treating agent is applied on the base paper in an amount of 0.5–4.0 g/m$^2$.

10. The offset printing paper according to claim 4, wherein the base paper is for newspaper.

11. The offset printing paper according to claim 10, wherein the surface-treating agent is applied on the base paper in an amount of 0.1–1.5 g/m$^2$.

12. A method of producing an offset printing paper, comprising the steps of:

preparing a surface-treating agent comprising mainly:

Constituent A consisting of water-soluble polymers;

Constituent B consisting of a surface sizing agent which is a water-soluble copolymer of a styrene type monomer and an anionic monomer, said copolymer containing 20 to 80% by weight of the styrene type monomer; and Constituent C consisting of a surface sizing agent which is a water-soluble copolymer of an olefin type monomer and an anionic monomer, said copolymer containing 20 to 80% by weight of the olefin type monomer;

applying the surface-treating agent on a base paper to form a coating thereon; and drying the coating.

13. The method according to claim 12, wherein the offset printing paper has a drop water absorbency of 10 to 300 seconds as measured upon dropping one microliter of water, and a contact angel of approximately 90 to 106 degrees as measured 0.1 seconds after dropping five microliters of water.

14. The method according to claim 12, wherein the surface-treating agent has a weight ration of constituents A/B/C of approximately 100/0.1–50/0.1–50.

15. The method according to claim 14, wherein the weight ration of Constituents A/B/C is approximately 100/2–20/2–20.

16. The method according to claim 12, wherein the surface-treating agent contains no other elements adversely affecting the drop water absorbency and the contact angle.

17. The method according to claim 12, wherein the surface-treating agent is applied on the base paper in an amount of 0.5–4.0 g/m$^2$.

18. The method according to claim 12, wherein the base paper is for newspaper.

19. The method according to claim 18, wherein the surface-treating agent is applied on the base paper in an amount of 0.1–1.5 g/m$^2$.

* * * * *